US008430734B2

(12) United States Patent
Choi

(10) Patent No.: US 8,430,734 B2
(45) Date of Patent: Apr. 30, 2013

(54) METHOD AND COMPUTER PROGRAM PRODUCT FOR DEALING A TWO-STAGE CARD GAME WITH PARTIAL GAMING CRITERIA

(75) Inventor: Roy Choi, Los Angeles, CA (US)

(73) Assignee: Fortiss, LLC, Los Angeles, CA (US)

( * ) Notice: Subject to any disclaimer, the term of this patent is extended or adjusted under 35 U.S.C. 154(b) by 62 days.

(21) Appl. No.: 12/890,529

(22) Filed: Sep. 24, 2010

(65) Prior Publication Data

US 2012/0077576 A1 Mar. 29, 2012

(51) Int. Cl.
*A63F 9/24* (2006.01)

(52) U.S. Cl.
USPC ..... 463/13; 273/292; 273/293; 463/16; 463/20

(58) Field of Classification Search ..... 273/292–293; 463/13, 16, 20
See application file for complete search history.

(56) References Cited

U.S. PATENT DOCUMENTS 6,132,311 A * 10/2000 Williams ..... 463/13
6,443,456 B1 * 9/2002 Gajor ..... 273/303
2006/0119044 A1 * 6/2006 Kekempanos et al. ..... 273/292
2006/0125180 A1 * 6/2006 LaRose ..... 273/292
2006/0128454 A1 * 6/2006 Berman et al. ..... 463/13
2007/0085273 A1 * 4/2007 Feola ..... 273/292
2007/0241506 A1 * 10/2007 Kling et al. ..... 273/292
2008/0258391 A1 * 10/2008 Kniffen ..... 273/293
2008/0272546 A1 * 11/2008 Forster ..... 273/292
2009/0042630 A1 * 2/2009 Sklansky et al. ..... 463/13
2010/0044963 A1 * 2/2010 Feola ..... 273/292
2010/0109246 A1 * 5/2010 Ramirez ..... 273/292
2011/0101612 A1 * 5/2011 Feola ..... 273/292

* cited by examiner

*Primary Examiner* — Dmitry Suhol
*Assistant Examiner* — Jason Yen
(74) *Attorney, Agent, or Firm* — Sheppard Mullin Richter & Hampton LLP

(57) ABSTRACT

The present invention provides a method for dealing a card game, comprising: calling for all pick-row, pair-plus bonus, and no-peek bonus bets; dealing three rows of two card poker hands face up in positions A, B, and C; confirming whether there exists a qualifying card in one of the hands; collecting all losing pick-row wagers if none of the hands qualify; giving action to all pick-row bets if there is a qualifying hand; establishing a winning two-card poker hand among A, B, and C; dealing three sets of three cards face up to each row to complete five card poker hands in positions A, B, and C; establishing all no-peek bonus qualifying hands; announcing a value of all qualifying five-card poker hands; and reconciling winning and losing no-peek super bonus bets and, paying winning bets from right to left.

9 Claims, 2 Drawing Sheets

METHOD AND COMPUTER PROGRAM PRODUCT FOR DEALING A TWO-STAGE CARD GAME WITH PARTIAL GAMING CRITERIA

FIELD OF THE INVENTION

The present invention relates generally to gaming and more particularly to a method and computer program product for dealing a card game.

BRIEF SUMMARY OF EMBODIMENTS OF THE INVENTION

According to various embodiments of the invention, a method is provided for dealing a card game, comprising: calling for all pick-row bets, pair-plus bonus bets, and no-peek bonus bets; dealing three cards at a time and placing a first and second set of three cards face-up such that hand positions A, B, and C each have a two-card poker hand; looking for and confirming whether there exists a qualifying card in one of the three hands; collecting all losing pick-row wagers if none of the three hands qualify; giving action to all pick-row bets if there is a qualifying hand; establishing a winning two-card poker hand among A, B, and C; calling for all peek bonus bets; dealing three cards at a time and placing a third, fourth and fifth set of three cards face-up such that hand positions A, B, and C each have a five-card poker hand; establishing any and all five-card peek and no-peek bonus qualifying hands; announcing a value of all qualifying five-card poker hands; and reconciling winning and losing no-peek super bonus bets and peek bonus bets, and, in turn, paying winning bets from right to left.

In one implementation of the above-described method, the cards are dispensed using a shuffle machine. The method may further comprise reconciling winning and losing pick-row bets and pair-bonus bets, and, in turn, paying winning bets from right to left. In some embodiments, the step of dealing three cards at a time and placing a first and second set of three cards face-up comprises: (i) placing the first set of three cards face-up to the far right of a dealer position, pulling downward, leaving a top card in a top row, leaving a middle card in a middle row and leaving a bottom card in a bottom row, and (ii) placing a second set of three cards to the left of the first set of three cards, pulling downward, leaving a top card at the top row, leaving a middle card at the middle row and leaving a bottom card at the bottom row. In addition, the step of dealing three cards at a time and placing a third, fourth and fifth set of three cards face-up may entail: (i) placing a third set of three cards to the left of the second set of three cards, pulling downward, leaving a top card in a top row, leaving a middle card in a middle row and leaving a bottom card in a bottom row, (ii) placing a fourth set of three cards to the left of the third set of three cards, pulling downward, leaving a top card in a top row, leaving a middle card in a middle row and leaving a bottom card in a bottom row, and (iii) placing a fifth set of three cards to the left of the fourth set of three cards, pulling downward, leaving a top card in a top row, leaving a middle card in a middle row and leaving a bottom card in a bottom row.

In certain embodiments of the method, a qualifying card comprises a Queen or better in one of the three hands. The above method may further comprise establishing any and all two-card bonus qualifying hands after establishing the winning two-card poker hand among A, B, and C. Additionally, the step of reconciling winning and losing no-peek super bonus bets and peek bonus bets may comprise paying winning bets from right to left and collecting chips from losers. In some embodiments, the method may further comprise clearing the hand, shuffling the cards and restarting the method.

Another embodiment of the invention is directed toward a non-transitory computer readable medium having computer executable program code embodied thereon, the computer executable program code configured to cause a computing device to: call for all pick-row bets, pair-plus bonus bets, and no-peek bonus bets; deal three cards at a time and place a first and second set of three cards face-up such that hand positions A, B, and C each have a two-card poker hand; look for and confirm whether there exists a qualifying card in one of the three hands; collect all losing pick-row wagers if none of the three hands qualify; give action to all pick-row bets if there is a qualifying hand; establish a winning two-card poker hand among A, B, and C; call for all peek bonus bets; deal three cards at a time and placing a third, fourth and fifth set of three cards face-up such that hand positions A, B, and C each have a five-card poker hand; establish any and all five-card peek and no-peek bonus qualifying hands; announce a value of all qualifying five-card poker hands; and reconcile winning and losing no-peek super bonus bets and peek bonus bets, and, in turn, pay winning bets from right to left.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention.

Figure 1:
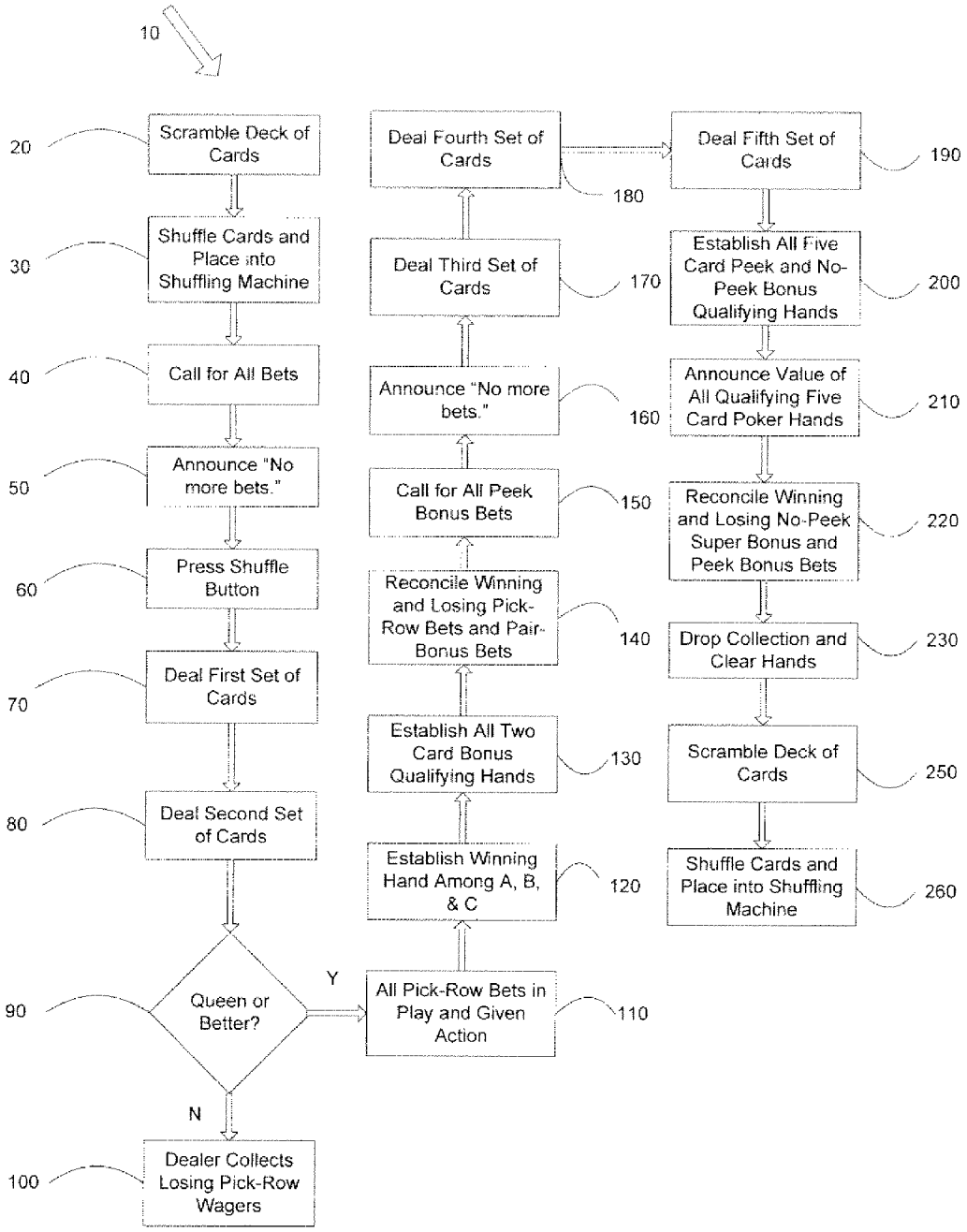
FIG. 1 is a flowchart illustrating a method for dealing Two-Card Peek in accordance with the principles of the invention.

These figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a game of skill (i.e., poker) that is played using a deck of cards or is implemented as a computer program product comprising a non-transitory computer readable medium having computer executable program code embodied thereon, the computer executable program code configured to cause a computing device to simulate an actual card game (i.e., poker).

Game Overview

Some embodiments of the invention are directed toward a game (referred to herein as "Two-Card Peek") where the dealer deals out three, two-card hands to the players. After the first three hands are dealt, the dealer then deals out three more cards to each hand in order to make a complete five-card poker hand. Players are permitted to make pick-row wagers prior to the start of play to determine whether or not one of three two-card hands is a winner. According to certain embodiments, players may also make optional bonus bets on a pair-poker bonus bet, a peek bonus, and a no-peek super bonus bet. Any of the four different types of bets are interchangeable in that, e.g., the peek bet may be removed and the game can operate with just the three remaining type of bets.

Another embodiment of the invention includes a changeable option to have three community cards for the super bonus. In one implementation, the peek bet option is removed, and the dealer instead quickly deals out the three community cards to satisfy the super bonus. This version of the game is significantly faster than other versions.

Pick-Row Wager

A pick-row wager is made prior to the dealing of any cards. All players choose one of three hands to play (i.e., A, B, or C). As a qualifier, the dealer must have dealt at least one hand with a poker ranking of at least Jack-high. Provided that the qualifier is met, the hand with the highest poker ranking (either A, B, or C) is the winner and all other hands are losers. However, in the event that the qualifier is not met, then the highest pick-row wager pushes (i.e., ties) with the dealer, and all other pick-row wagers are losers. According to some embodiments, winning pick-row wager hands are paid as follows: Jack-High or better pays 2:1. It follows that all pick-row wager hands of 10-High or less are losers. As would be appreciated by those of skill in the gaming arts, other winning hand variations and payment structures are possible without departing from the scope of the invention.

Bonus Bets

According to an embodiment of the invention, a pair poker bonus bet may be made on any of the three hands (A, B, or C) and paid out according to the hand ranking. Players are paid odds on a qualifying two-card hand depending on their rank. In some embodiments, all pair poker bonus bets are paid as follows: (i) Non-ranking hands are losers; (ii) Two-card flush pays 1:1; (iii) Two-card straight, off suit, pays 1:1; (iv) Pair pays 3:2; (v) Two-card straight flush pays 3:1; and (vi) Mini-Royal, AK suited, pays 10:1. As would be understood by those of skill in the gaming arts, other winning hand variations and payment structures are possible without departing from the scope of the invention.

According to another embodiment of the invention, a no-peek bonus bet may be made before any cards are dealt prior to the start of the round. After the first three hands are, dealt by the dealer and all pick-row bets are resolved, the dealer deals three more cards to each of the two-card hands to make a complete five-card poker hand. In one implementation, the no-peek bonus pays out for any poker hand that is rated two-pair or higher, and players can win on one, two, or all three hands off of a single wager. In some embodiments, winning no-peek bonus bets are paid as follows: (i) Two-Pair or less will lose; (ii) Three of a Kind pays 5:1; (iii) Straight pays 7:1; (iv) Flush pays 15:1; (v)/full House pays 30:1; (vi) Four of a Kind pays 100:1; (vii) Straight Flush pays 2,000:1; and (viii) Royal Flush pays 20,000:1. As would be appreciated by one of skill in the gaming arts, other winning hand variations and payment structures are possible without departing from the scope of the invention.

According to further embodiments of the invention, a peek bonus bet may be made after the dealer deals out the three two-card hands, but prior to the completion of the five-card hands. Players have the option to place a peek bet on any of the three hands (A, B, or C) that were dealt out. The hand is resolved after the remaining cards are dealt and the best five-card poker hand is determined for each hand. According to one implementation, winning peek bonus bets pay out for any five-card poker hand that is rated two-pair or better as follows: (i) Non-ranking hands are losers; (ii) Two-Pair pays 1:1; (iii) Three of a Kind pays 2:1; (iv) Straight pays 10:1; (v) Flush pays 30:1; (vi) Full-house pays 15:1; (vii) Four of a Kind pays 40:1; (viii) Straight Flush pays 250:1; and (ix) Royal Flush pays 500:1. As would be appreciated by those of skill in the gaming arts, other winning hand variations and payment structures are possible without departing from the scope of the invention.

Dealing Procedures:

Referring to FIG. 1, a method 10 for dealing Two-Card Peek will now be described. An initial step 20 in the method entails lightly scrambling a deck of cards. The next step 30 entails shuffling once and placing the deck into a conventional shuffle machine. In step 40, the dealer calls for all pick-row bets, pair-plus bonus bets, and no-peek bonus bets. In step 50, the dealer announces, "No more bets." Step 60 involves the dealer pressing the button on the shuffler, whereby the machine dispenses three cards at a time. Step 70 involves the dealer placing the first set of three cards (face-up) to the far right of the dealer position, pulling downward, leaving the top card in a top row, leaving the middle card in a middle row and leaving the bottom card in a bottom row. Likewise, step 80 involves the dealer placing the second set of three cards to the left of the first set of three cards and repeating the pull down procedure. From left to right, hand positions A, B, and C will now each have a two-card poker hand.

With further reference to FIG. 1, step 90 involves the dealer looking for and confirming that there exists a qualifying card in one of the three hands. According to one embodiment, in order for the pick-row bet to qualify in step 90, there must be a Queen or better in one of the three hands. If none of the three hands qualify in step 90, then the dealer will collect all losing pick-row wagers in step 100. However, if there is a qualifying hand, then all pick-row bets are in play and are given action (step 110). In step 120, the dealer establishes the winning hand among A, B, and C. In step 130, the dealer establishes any and all two-card bonus qualifying hands. Step 140 involves the dealer reconciling winning and losing pick-row bets and pair-bonus bets, and, in turn, paying from right to left. Step 150 entails the dealer calling for all peek bonus bets, whereas step 160 entails the dealer announcing, "No more bets."

With continued reference to FIG. 1, step 170 involves placing the third set of three cards to the left of the second set of three cards and repeating the aforementioned pull down procedure. Step 180 entails placing the fourth set of three cards to the left of the third set of three cards and repeating the pull down procedure, while step 190 entails placing the fifth set of three cards to the left of the fourth set of three cards and repeating the pull down procedure. In step 200, the dealer establishes any and all five-card peek and no-peek bonus qualifying hands. Step 210 involves the dealer announcing the value of all qualifying five-card poker hands. In step 220, the dealer reconciles winning and losing "no-peek super bonus" bets and "peek bonus" bets, and, in turn, pays from right to left. According to an embodiment of the invention, the dealer reconciles the action in the following way: (i) for winning bets, the dealer pays the player and pushes back the chips; (ii) for losing bets, the dealer collects the chips. In step 230, the dealer drops the collection and clears the hands. Step 250 entails lightly scrambling the deck, while step 260 entails shuffling once and placing the deck in the shuffle machine. In cases where the shuffle machine breaks, or no shuffle machine is available for the game, then the game can be played without bonus hand payouts for the peek and no-peek bonus bets.

According to further embodiments of the invention, the game of Two-Card Peek may be played using a fourth row of cards. According to such embodiments, the shuffle machine dispenses 4 cards at a time and the dealer. Then, the dealer places the first set of four cards (face-up) to the far right of the dealer position and pulls the four cards downward to form the four rows.

In another embodiment of the invention, the game of Two-Card Peek may include Jokers. In such an embodiment, a Joker may act as a wild card, or may be employed in any conventional manner.

As used herein, the term "set" may refer to any collection of elements, whether finite or infinite. The term "subset" may refer to any collection of elements, wherein the elements are taken from a parent set; a subset may be the entire parent set. The term "proper subset" refers to a subset containing fewer elements than the parent set. The term "sequence" may refer to an ordered set or subset. The terms "less than," "less than or equal to," "greater than," and "greater than or equal to," may be used herein to describe the relations between various objects or members of ordered sets or sequences; these terms will be understood to refer to any appropriate ordering relation applicable to the objects being ordered.

The term "tool" can be used to refer to any apparatus configured to perform a recited function. For example, tools can include a collection of one or more modules and can also be comprised of hardware, software or a combination thereof. Thus, for example, a tool can be a collection of one or more software modules, hardware modules, software/hardware modules or any combination or permutation thereof. As another example, a tool can be a computing device or other appliance on which software runs or in which hardware is implemented.

As used herein, the term "module" might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the invention are implemented in whole or in part using software, in one embodiment, these software elements can be implemented to operate with a computing or processing module capable of carrying out the functionality described with respect thereto. One such example computing module is shown in FIG. 15. Various embodiments are described in terms of this example-computing module 300. After reading this description, it will become apparent to a person skilled in the relevant art how to implement the invention using other computing modules or architectures.

Figure 2:
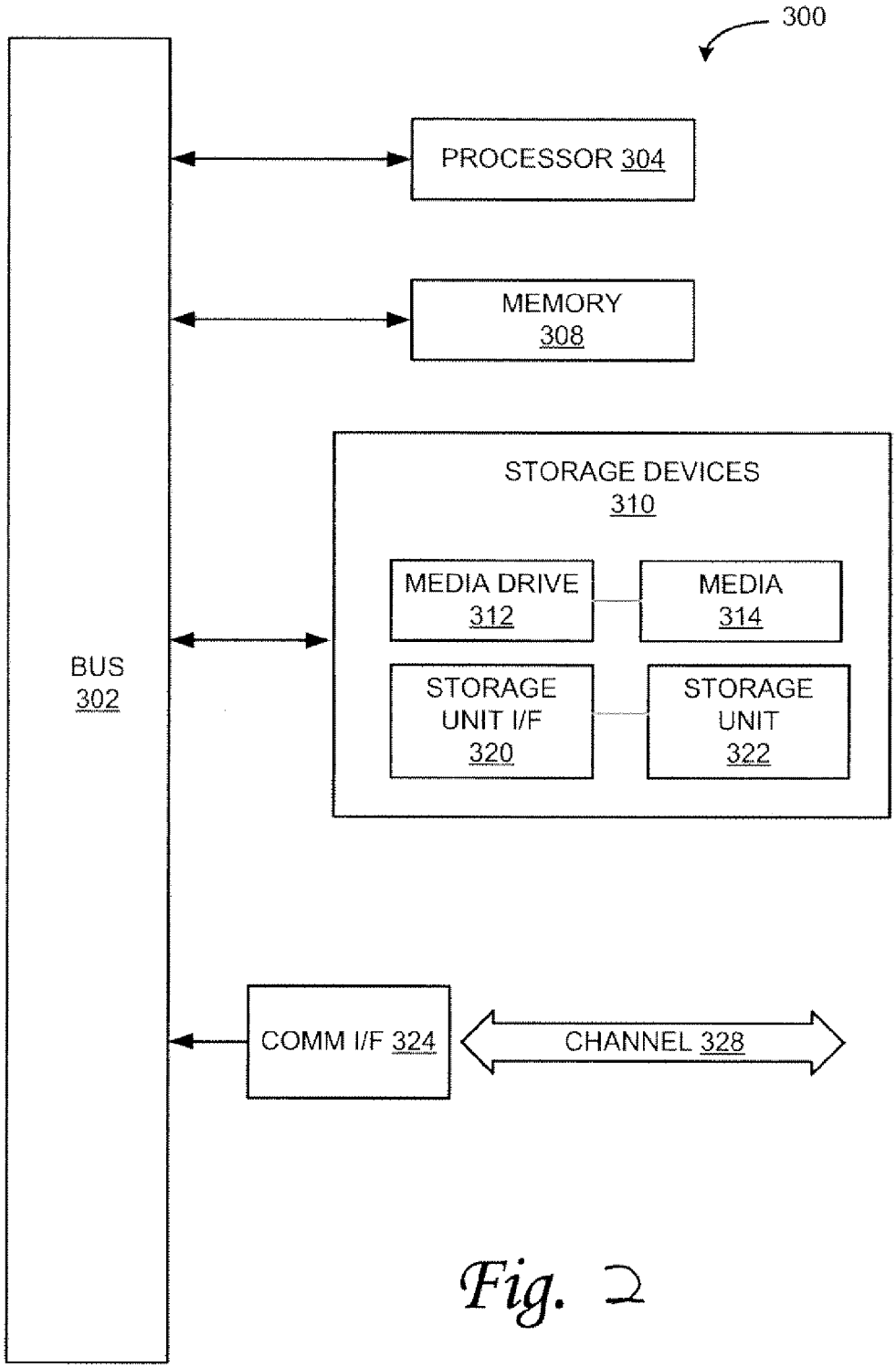
FIG. 2 is a diagram illustrating an example computing module for implementing various embodiments of the invention.

Referring now to FIG. 2, computing module 300 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 300 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 300 might include, for example, one or more processors, controllers, control modules, or other processing devices, such as a processor 304. Processor 304 might be implemented using a general-purpose or special-purpose processing engine such as, for example, a microprocessor, controller, or other control logic. In the illustrated example, processor 304 is connected to a bus 303, although any communication medium can be used to facilitate interaction with other components of computing module 300 or to communicate externally.

Computing module 300 might also include one or more memory modules, simply referred to herein as main memory 308. For example, preferably random access memory (RAM) or other dynamic memory, might be used for storing information and instructions to be executed by processor 304. Main memory 308 might also be used for storing temporary variables or other intermediate information during execution of instructions to be executed by processor 304. Computing module 300 might likewise include a read only memory ("ROM") or other static storage device coupled to bus 303 for storing static information and instructions for processor 304.

The computing module 300 might also include one or more various forms of information storage mechanism 310, which might include, for example, a media drive 312 and a storage unit interface 320. The media drive 312 might include a drive or other mechanism to support fixed or removable storage media 314. For example, a hard disk drive, a floppy disk drive, a magnetic tape drive, an optical disk drive, a CD, DVD or Blu-ray drive (R or RW), or other removable or fixed media drive might be provided. Accordingly, storage media 314 might include, for example, a hard disk, a floppy disk, magnetic tape, cartridge, optical disk, a CD, DVD or Blu-ray, or other fixed or removable medium that is read by, written to or accessed by media drive 312. As these examples illustrate, the storage media 314 can include a computer usable storage medium having stored therein computer software or data.

In alternative embodiments, information storage mechanism 310 might include other similar instrumentalities for allowing computer programs or other instructions or data to be loaded into computing module 300. Such instrumentalities might include, for example, a fixed or removable storage unit 322 and an interface 320. Examples of such storage units 322 and interfaces 320 can include a program cartridge and cartridge interface, a removable memory (for example, a flash memory or other removable memory module) and memory slot, a PCMCIA slot and card, and other fixed or removable storage units 322 and interfaces 320 that allow software and data to be transferred from the storage unit 322 to computing module 300.

Computing module 300 might also include a communications interface 324. Communications interface 324 might be used to allow software and data to be transferred between computing module 300 and external devices. Examples of communications interface 324 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 324 might typically be carried on signals, which can be electronic, electromagnetic (which includes optical) or other signals capable of being exchanged by a given communications interface 324. These signals might be provided to communications interface 324 via a channel 328. This channel 328 might carry signals and might be implemented using a wired or wireless communication medium. Some examples of a channel might include a phone line, a cellular link, an RE link, an optical link, a network interface, a local or wide area network, and other wired or wireless communications channels.

In this document, the terms "computer program medium" and "computer usable medium" are used to generally refer to media such as, for example, memory 308, storage unit 320, media 314, and channel 328. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 300 to perform in features or functions of the present invention as discussed herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal." "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A non-transitory computer readable medium having computer executable program code embodied thereon, the computer executable program code configured to cause a computing device to:

execute a first stage of the card game, comprising:

calling for all pick-row bets, pair-plus bonus bets, and no-peek bonus bets;

dealing three cards at a time and place a first and second set of three cards face-up such that hand positions A, B, and C each have a two-card poker hand;

looking for and confirming whether there exists a qualifying card in one of the three hands;

collecting all losing pick-row wagers if none of the three hands qualify;

giving action to all pick-row bets if there is a qualifying hand;

establishing a winning two-card poker hand among A, B, and C;

execute a second stage of a card game when at least one of the three hands qualified in the first two sets of cards, comprising:

dealing three cards at a time and placing an additional third, fourth and fifth set of three cards face-up next to the first two sets of cards such that hand positions A, B, and C each have a five-card poker hand;

establishing any and all no-peek bonus qualifying hands;

announcing a value of all qualifying five-card poker hands; and reconciling winning and losing no-peek super bonus bets, and, in turn, paying winning bets.

2. The non-transitory computer readable medium of claim 1, wherein the computer executable program code is further configured to reconcile winning and losing pick-row bets and pair-bonus bets, and, in turn, pay winning bets.

3. The non-transitory computer readable medium of claim 1, wherein dealing three cards at a time and placing a first and second set of three cards face-up comprises: (i) graphically displaying the first set of three cards face-up, displaying first a top card in a top row, displaying second a middle card in a middle row and displaying third a bottom card in a bottom row, and (ii) graphically displaying a second set of three cards to the left of the first set of three cards, displaying first a top card at the top row, displaying second a middle card at the middle row and displaying third a bottom card at the bottom row.

4. The non-transitory computer readable medium of claim 1, wherein a qualifying card comprises a Queen or better in one of the three hands.

5. The non-transitory computer readable medium of claim 1, wherein the computer executable program code is further configured to establish any and all two-card bonus qualifying hands after establishing the winning two-card poker hand among A, B, and C.

6. The non-transitory computer readable medium of claim 1, wherein dealing three cards at a time and placing a third, fourth and fifth set of three cards face-up comprises: (i) graphically displaying a third set of three cards to the left of the second set of three cards, displaying first a top card in a top row, displaying second a middle card in a middle row and displaying third a bottom card in a bottom row, (ii) graphically displaying a fourth set of three cards to the left of the third set of three cards, displaying first a top card in a top row, displaying second a middle card in a middle row and displaying third a bottom card in a bottom row, and (iii) graphically displaying a fifth set of three cards to the left of the fourth set of three cards, displaying first a top card in a top row, displaying second a middle card in a middle row and displaying third a bottom card in a bottom row.

7. The non-transitory computer readable medium of claim 1, wherein reconciling winning and losing no-peek super bonus bets comprises paying winning bets.

8. The non-transitory computer readable medium of claim 7, wherein reconciling winning and losing no-peek super bonus bets further comprises paying winners and graphically displaying the collection of poker chips from losers.

9. The non-transitory computer readable medium of claim 1, wherein the computer executable program code is further configured to clear the hand, shuffle the cards and restart the method.

* * * * *